United States Patent [19]

Biss et al.

[11] 4,342,648

[45] Aug. 3, 1982

[54] DIRECT FLOTATION OF PYROCHLORE

[75] Inventors: Rudy Biss, Chicoutimi Nord; Raymond Nadeau, Dubuc, both of Canada

[73] Assignee: Les Services TMG Inc., Dubuc, Canada

[21] Appl. No.: 261,132

[22] Filed: May 5, 1981

[51] Int. Cl.[3] ..... B03D 1/14

[52] U.S. Cl. ..... 209/166; 210/729

[58] Field of Search ..... 209/166, 12, 167; 210/735, 729

[56] References Cited

U.S. PATENT DOCUMENTS

| | | | |
|---|---|---|---|
| 2,297,689 | 10/1942 | O'Mealoy | 209/166 |
| 2,327,408 | 8/1943 | Ellis | 209/166 |
| 2,364,272 | 12/1944 | Christmann | 209/166 |
| 2,380,698 | 7/1945 | Jayne | 209/166 |
| 2,395,475 | 2/1946 | Gibbs | 209/166 |
| 2,483,192 | 9/1949 | Gieseke | 209/166 |
| 2,494,132 | 1/1950 | Jayue | 209/166 |
| 2,578,290 | 12/1951 | Duke | 209/166 |
| 2,708,666 | 5/1955 | Carpenter | 209/166 X |
| 2,792,404 | 5/1957 | Garmaise | 260/309.6 |
| 2,875,896 | 3/1959 | Last | 209/166 |
| 2,951,585 | 9/1960 | Burks | 209/167 |
| 2,959,281 | 11/1960 | Faucher | 209/12 |
| 3,014,585 | 12/1961 | Noblitt | 209/167 |
| 3,214,018 | 10/1965 | Neal | 209/166 |
| 3,910,836 | 10/1975 | Raby | 209/166 |
| 3,990,966 | 11/1976 | Stanley | 209/12 |

FOREIGN PATENT DOCUMENTS 2546180 4/1977 Fed. Rep. of Germany .

OTHER PUBLICATIONS

Hoechst Information Sheet 8.77 HOE F2603, HOE F2604 and HOE F2642, Cat. Collectors For-Non-Sulfide Minerals.

*Primary Examiner*—Norman Yudkoff

*Attorney, Agent, or Firm*—Ridout & Maybee

[57] ABSTRACT

Direct flotation of pyrochlore from its ore can be carried out at acidic pH using 1-amidoethyl-2-substituted imidazolines of the formula (I)

wherein R and R′ are independently alkyl or alkenyl of 8 to 22 carbons, or their salts. In the presence of large amounts of carbonate in the ore, the pulp is acidified with hydrofluoric acid, fluosilicic acid, or their acid reacting compounds. Using this process, pyrochlore concentrates can be obtained by direct flotation from ore containing 0.1% or more of sulphide compounds calculated as $FeS_2$.

12 Claims, 2 Drawing Figures

DIRECT FLOTATION OF PYROCHLORE

BRIEF SUMMARY OF THE INVENTION

The invention relates to processes for direct froth flotation of the valuable niobium-bearing mineral pyrochlore $NaCaNb_2O_6F$ from ores containing pyrochlore in admixture with gangue materials. By "direct froth flotation" we mean that the flotation is carried out on the whole ore or on an ore residue which has been subjected to a non-flotative pre-treatment.

It is known from U.S. Pat. No. 3,910,836 issued Oct. 7, 1975 in the name Raby et al. to conduct an indirect froth flotation wherein carbonates and silicates are prefloated from a pyrochlore-bearing ore. The tailings are then subjected to a pyrochlore flotation treatment in acid circuit in the presence of oxalic acid or oxalate, optionally together with hydrofluoric, sulfuric, hydrochloric, or phosphoric acid, employing as selective collector a mixture of ethoxylated fatty acids and a cationic collector of the diamine diacetate type containing straight carbon chains. In view of the high yields of pyrochlore concentrate having commercially-acceptable purity that can be obtained, this process has been employed extensively in commercial practice by the assignee of the present applicants for a number of years. The above-mentioned patent also proposes a direct pyrochlore flotation process but it has, however, been found that when attempts are made to apply the oxalate process to ores containing a substantial proportion of carbonates, normally largely in the form of calcite and magnesite, the oxalic acid or oxalate reacts with calcium ions in solution to form calcium oxalate resulting in heavy flotation cell scaling. Further, as a result of reaction of the oxalic acid or oxalate with the carbonate material there is a high consumption of acid, and owing to effervesence the pulp tends to foam, which makes it difficult to control the flotation. Further, the pH of the pulp tends to be unstable and is difficult or impossible to control. This pH instability is disadvantageous as the surface property of the pyrochlore is pH sensitive and close control of the pH is necessary for efficient flotation of the pyrochlore at acceptable niobium contents without flotation of excessive quantities of gangue materials.

It is also known to achieve pyrochlore flotation by an indirect process, as described in German Offenlegungsschrift No. 2546180 published Apr. 28, 1977 in the name Hoechst AG, in which, in alkaline circuit (pH above 7), an ore is subjected to a preliminary sulphide flotation, in which the pyrochlore material is depressed and a sulphide-rich flotation concentrate is removed. The main flotation recovery process is conducted on the tailings which, in alkaline circuit, are conditioned with a 1-amidoethyl-2-substituted imidazoline collector of the general formula

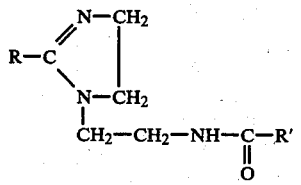

(I)

wherein R and R′ are independently selected from alkyl and alkenyl groups of 8 to 22 carbon atoms. This process is however somewhat inefficient as greater quantities of pyrochlore flotation agents have to be added to counteract the depressant effects of the conditioning agent added in the preliminary sulfide flotation step, which conditioning agent is recovered in the tailings from the sulphide flotation step along with the sulphide-poor minerals residue.

We have now found that in acidic circuit (pH below 7) the collectors of formula (I) can efficiently be employed as selective flotation collectors for the direct flotation of pyrochlore.

The invention provides a process for recovering a pyrochlore concentrate from an ore containing pyrochlore and gangue materials comprising substantial proportions of carbonates, said process comprising the steps of: forming an aqueous pulp of the ore in small particle size suitable for froth flotation; conditioning the pulp by adding thereto (a) a collector selected from the group consisting of 1-amidoethyl-2-substituted-imidazolines of the formula

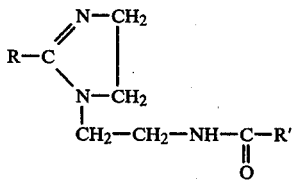

(I)

wherein R and R′ are independently selected from the group consisting of alkyl and alkenyl groups of 8 to 22 carbon atoms, their salts, and mixtures thereof, in an amount sufficient to collect at least a substantial proportion of the pyrochlore mineral present in the pulp, and (b) an acidic-reacting fluoridic compound selected from the group consisting of hydrofluoric acid, fluoride compounds, fluosilicic acid, fluosilicate compounds, and mixtures thereof in an amount sufficient to modify the pH of the pulp to a pH in the range about 2 to 6.5; subjecting the conditioned pulp to froth flotation; and recovering a concentrate froth relatively rich in pyrochlore.

The above-mentioned fluoridic compounds do not react with carbonate materials to any significant or troublesome extent and therefore with this process the difficulties that are encountered with oxalate materials are significantly reduced or avoided. Moreover, it has been found that, in combination with the imidazoline collectors of formula (I), there may be obtainable, using direct flotation, pyrochlore concentrates in yields and with degrees of purity comparable with those formerly obtained with the above-mentioned oxalate process.

We have further found that the collectors of formula (I) in acid circuit may be employed for the first flotation of pyrochlore without a preliminary sulphide flotation step, from ores containing as much as or in excess of 0.1% by weight sulphide, calculated as pyrite ($FeS_2$), more especially from ores containing 0.15 to 3% of sulphide calculated as pyrite ($FeS_2$).

Accordingly, the invention also provides a process for recovering a pyrochlore concentrate by direct froth flotation from an ore containing pyrochlore and gangue materials comprising sulphide, comprising the steps of: forming an aqueous pulp of the ore in small particle size suitable for froth flotation and containing at least 0.1% by weight sulphide compounds calculated as pyrite ($FeS_2$); conditioning the pulp by adding thereto an amount of a collector selected from the group consisting of 1-alkylamidoethyl-2-substituted imidazolines of the formula

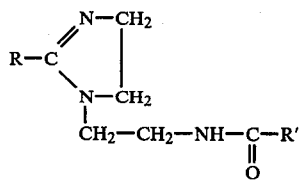

(I)

wherein R and R′ are independently selected from the group consisting of alkyl and alkenyl groups of 8 to 22 carbon atoms, and their salts, and mixtures thereof; subjecting the conditioned pulp at an acidic pH to froth flotation; and recovering a concentrate froth relatively rich in pyrochlore.

DETAILED DESCRIPTION

Figure 1:
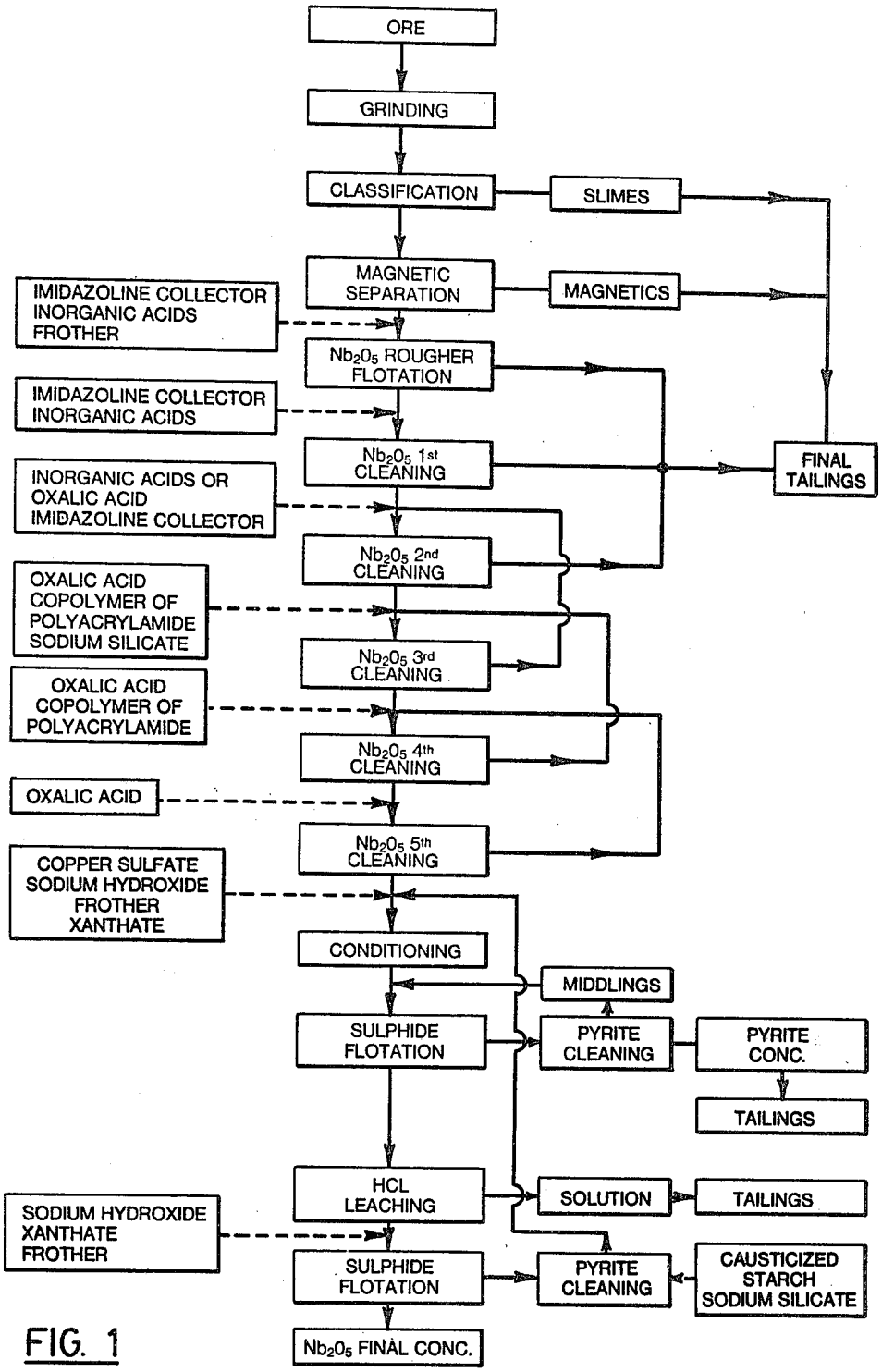
FIG. 1 is a flowsheet of a process embodying the invention.

FIG. 1 illustrates one embodiment of the invention wherein an ore having a high carbonate content is subjected to direct pyrochlore flotation.

A typical ore composition high in carbonate content is as follows:

TABLE I

| | % by wt. |
|---|---|
| $Nb_2O_5$ | 0.64 |
| MgO | 12.05 |
| CaO | 32.12 |
| $SiO_2$ | 2.84 |
| $P_2O_5$ | 2.22 |
| $Fe_t$ | 4.83 |

The main minerals present are:

| | | | |
|---|---|---|---|
| pyrochlore | $NaCaNb_2O_6F$ | apatitite | $Ca_5(PO_4)_3$ (OH,Fe,Cl) |
| columbite | (Fe,Mn) $(NbTa)_2O_6$ | biotite | $K(Mg,Fe)_3AlSi_3O_{10}(OHF)_2$ |
| calcite | $CaCO_3$ | alkaline feldspars (various compositions) | |
| dolomite | $CaMg(CO_3)_2$ | magnetite | $Fe_3O_4$ |
| pyrite | $FeS_2$ | hematite | $Fe_2O_3$ |

The carbonate content of this ore is about 75% (calculated as calcium carbonate). The process of the invention is especially useful for processing of ores containing relatively large carbonate contents e.g. at least about 50% carbonate (calculated as calcium carbonate) or higher e.g. at least about 60%.

The sulphide content of the ore to which the process of the invention can be applied can be as much as or more than 0.1% (calculated as pyrite $FeS_2$), but the process may also be readily applied to ores having sulphide contents in excess of 3% by weight calculated as $FeS_2$.

Referring to the example of FIG. 1, it is found that the imidazoline collectors exhibit increasing selectivity toward pyrochlore with decreasing pH, but greatly reduced recoveries of flotation concentrate are obtained. It is therefore normally more efficient to conduct the separation in a plurality of stages at progressively decreasing pHs, i.e. in an $Nb_2O_5$ rougher stage and several $Nb_2O_5$ cleaner stages, as in FIG. 1, so that in the successive stages a progressively greater selectivity is applied to the pyrochlore separation.

In the example of FIG. 1, the whole ore is ground, to a fineness of 95%–65 mesh, an aqueous pulp thereof is subjected to classification by conventional means, and slimes ($-10\mu$) are rejected. The deslimed pulp is optionally subjected to conventional magnetic separation and the magnetics fraction is discarded as final tailings.

The non-magnetic concentrate is formed into an aqueous pulp of solids content suitable for froth flotation and is conditioned by mixing it with an imidazoline collector, inorganic acids, and, optionally, a frother, prior to subjecting it to a pyrochlore rougher flotation. In this invention, the imidazoline collector comprises one or more imidazoline compounds of the formula

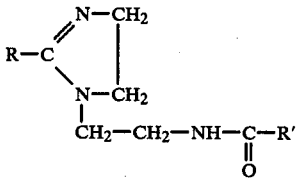

(I)

in which R and R′ are alkyl or alkenyl groups of 8 to 22 carbons, or a salt or salts or such collector, or mixtures of one or more of said imidazoline compounds with one or more of said salts. Preferably, for ease of dispersion of the collector into the pulp, the collector is in the form of a salt of relatively high water solubility, for example a salt of an inorganic acid e.g. a chloride salt, or more advantageously a water soluble salt of a low molecular weight organic salt. Acetate salts have been found to be particularly effective.

Especially preferred by reason of their superior selectivity towards pyrochlore are collectors of formula (I) wherein R and R′ are independently alkyl groups, more particularly alkyl groups of about 12 to 18 carbon atoms. Examples of such collectors include cationic collectors commercially available from Hoechst AG, Frankfurt, West Germany, under the trade marks HOE F 2603, HOE F 2604 and HOE F 2642. These products are viscous yellow to brown liquids which can be readily diluted with water.

The quantity of collector to be used will in each case depend on the nature and composition of the particular kind of ore undergoing processing. Above a certain level, increasing additions of the collector do not significantly increase the amount of pyrochlore present in the floated-off concentrate. In order to avoid excessive consumption of the collector and of other processing reagents which may be required to be added in subsequent processing stages to counteract the effects of the collector, it is desirable not to use excessive quantities of the collector above the amount sufficient to collect in the rougher froth concentrate at least about 85%, more preferably at least about 90% of the pyrochlore (calculated as $Nb_2O_5$) present in the original feed. Typically the collector will be used in the rougher stage in an amount of about 0.2 to about 2 lbs per ton of feed more typically about 0.5 to about 1.5 lbs per ton of feed.

The inorganic acids which are employed to provide an acidic pH should be, at least in the early stages of the processing, acidic-reacting fluoridic compounds which are selected from the group consisting of hydrofluoric acid, fluosilicic acid, fluosilicate compounds and mixtures thereof. These fluoridic compounds have the advantage that they do not react very much with carbonate, and do not form precipitates in the presence of calcium ions and therefore their use is not attended by such problems as heavy flotation cell scaling, unstable pH and high acid consumption. By reason of their corrosivity and toxicity the use of HF and fluorides is not preferred, and the preferred reagents are fluosilicic acid $H_2SiF_6$ and acid-reacting fluosilicate compounds. The preferred material is fluosilicic acid, used as a dilute aqueous solution. Sufficient of the fluoridic compound is used in the rougher stage to achieve a pH below about 6.5. As noted above, in order to avoid excessively low yields, it is normally desirable to operate the process in successive stages at progressively lower pH. Further, in the case of ore containing high quantities of carbonate, it is usually not practicable to acidify the pulp to a low pH until substantial quantities of carbonate have been removed, to avoid excessive acid consumption. In the case of high grade ore of relatively lower carbonate content, and where low yields do not present a problem, the ore may be acidified to a low pH in the region of about pH2. Usually, however, in the rougher stage the pH should be in the range about 4.5 to 6.5, more preferably about 5.5 to 5.8. However, in the case of ores which initially have relatively low carbonate contents, substantially greater quantities of the fluoridic compounds may be added, to achieve a pH in the range about 2 to 6.5. The use of a frother in the rougher stage may be found to contribute to the efficiency of the separation. If used, there may be employed any frother conventionally employed in pyrochlore flotation processes, such as DOW 250, employed in aqueous solution.

The tailings from the rougher flotation are discarded and the froth concentrate is recovered and is conditioned by addition of further quantities of the imidazoline collector and further quantities of the fluoridic acid material to achieve a pH lower than in the rougher stage, typically about pH 5.5 or below, depending on the carbonate content. The conditioned pulp is subjected to a first cleaner flotation. The tailings are discarded and the froth concentrate is passed to the second cleaner flotation stage.

Depending on the original carbonate content of the ore, the carbonate content of the concentrate from the first cleaner stage may be sufficiently low that oxalic acid solution may be added as a conditioning agent and to lower the pH at this point. Normally, the use of oxalic acid is to be avoided until practically all the carbonate has been removed to avoid problems of reaction between calcium and carbonate ions with oxalic, as discussed above. Thus if the carbonate content is sufficiently low oxalic may be added, but if it is not it is desirable to condition the concentrate for flotation in the second cleaner stage by an addition of further quantities of the fluoridic acid compounds, to achieve a pH lower than in the first cleaner stage, typically about pH 4.5. Further quantities of the imidazoline collector are also added and the pulp is subjected to a second cleaner froth flotation. The tailings are discarded.

At this point, normally the concentrate obtained from the second cleaner represents about 10% of the weight of the original feed of ore, and practically all carbonate has been removed. As the imidazoline collector tends to float large quantities of silicate e.g. biotite, it is usually desirable to carry out a further flotation stage or stages in the presence of a silicate depressant. Desirably where, as in the case of the ore of Table I, there is a substantial content of iron, an iron oxide minerals depressant is also employed. Any conventional silicate and iron minerals gangue depressants may be employed. In the preferred form, the gangue depressants comprise sodium silicate and a polyacrylamide copolymer depressant such as DK813 available from Allied Colloids (U.K.). This combination serves as an effective depressant for biotite, chlorite, silicates, and iron oxides. As the carbonate content is now very low, oxalic acid may be added as a pH regulator and gangue depressant, to achieve a pH of about 3.5. The conditioned pulp is subjected to a 3rd cleaning flotation, and the tailings are returned to the feed to the second cleaning stage.

The concentrate is conditioned to pH about 3 by addition of oxalic acid and further quantities of gangue depressant e.g. polyacrylamide are added. The pulp is subjected to a 4th cleaner flotation and the tailings are returned to the feed to the 3rd cleaner.

The froth concentrate is acidified to about pH 2 to 2.5 with oxalic acid. Depending on the condition of the ore, a further quantity of gangue depressant, e.g. polyacrylamide copolymer, may be added, and the conditioned pulp is subjected to a 5th cleaning flotation. The tailings are returned to the feed to the 4th cleaner.

Normally, the froth concentrate obtained from the 5th cleaner will represent about 1 to 5% by weight of the original feed, and will contain a concentration of pyrochlore (calculated as $Nb_2O_5$) which is some 25 to 35 times the concentration of pyrochlore in the original ore. The main impurities present are sulphides (mainly pyrite), together with some apatite and carbonate. The concentrate is subjected to conventional processing to further beneficiate the product, including removal of sulphides and acid leaching to remove carbonate and apatite. As shown in FIG. 1 the processing includes conditioning with conventional conditioning agents such as copper sulfate, sodium hydroxide, a frother, and a xanthate, and subjecting the conditioned pulp to sulphide flotation. The sulphide froth concentrate can be subjected to flotation cleaning stages and the tailings (middlings) therefrom be returned to the sulphide rougher flotation stage, the pyrite concentrate being discarded.

The tailings from the sulphide rougher flotation cell are subjected to leaching with dilute hydrochloric acid, preferably used hot e.g. at about 80° C. This removes most of the remaining carbonate and apatite from the niobium concentrate. The washings are discarded. The residue is subjected to a further sulphide flotation stage after conditioning with such conventional conditioning reagents as sodium hydroxide, xanthate, and frother material. The pyrite concentrate may be subjected to a further cleaning stage after conditioning with gangue depressants such as causticized starch and sodium silicate, the flotation concentrate (pyrite concentrate) being discarded and the tailings being recycled to the concentrate obtained from the 5th niobium cleaner stage.

The tailings from the sulphide flotation step (niobium concentrate) is recovered as the final niobium concentrate.

Figure 2:
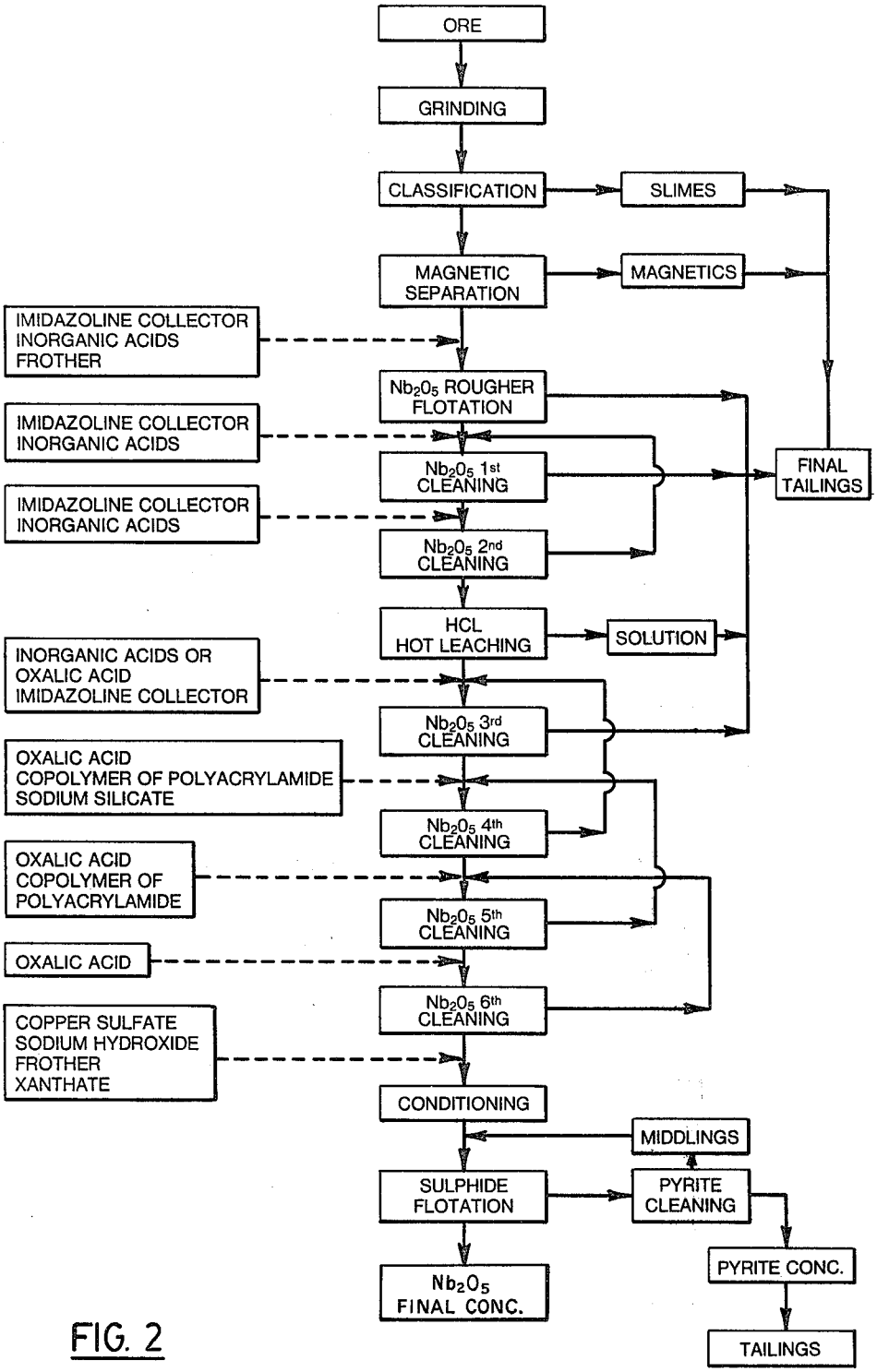
FIG. 2 is a flowsheet of a further embodiment of the invention.

FIG. 2 illustrates a second embodiment of a process applicable to an ore having a relatively lower carbonate content, and having a relatively high silicate and iron oxide content.

A typical ore composition relatively high in silicate and iron oxide contents and relatively low in carbonate content is as follows.

TABLE 2

| | % by weight |
|---|---|
| $Nb_2O_5$ | 0.77 |
| MgO | 13.03 |
| CaO | 25.61 |
| $SiO_2$ | 7.03 |
| $P_2O_5$ | 3.05 |
| $Fe_t$ | 9.67 |

The same minerals are present in this ore composition as in Table 1 except the proportions of alkaline feldspars, magnetite and hematite are raised considerably. The hematite is finely disseminated throughout the ore. The content of carbonate in this composition is about 60% calculated as calcium carbonate.

The process of FIG. 2 is similar in most respects to that described above in detail with reference to FIG. 1, the process being conducted in successive flotation stages at progressively decreasing pH, the pH in the $Nb_2O_5$ rougher flotation stage being about 5.5 to 5.8 and in the final (6th) cleaner stage being about 2 to 2.5. It will be noted that in this instance the ore was very difficult and as the iron oxides were finely disseminated throughout the ore, or formed a coating on the majority of the ground ore particles, the pyrochlore crystals were not completely liberated by grinding. Also, as noted above, a higher content of silicate was present.

The procedure employed six $Nb_2O_5$ cleaning stages instead of the five required in the process of FIG. 1. Tailings from the 2nd $Nb_2O_5$ cleaning stage were recycled to the feed to the first cleaning stage instead of being discarded, to avoid excessive loss of pyrochlore from the system. It was desirable to conduct the hot HCl leaching step an an earlier stage, following the second $Nb_2O_5$ cleaning step in order to liberate the pyrochlore mineral particles from the iron oxide forming a film on their surfaces. In the following cleaning step, i.e. the 3rd $Nb_2O_5$ cleaning step, the tailings could be discarded, as it contained a high proportion of gangue materials and lower quantities of $Nb_2O_5$ than the tailings from the corresponding cleaner stage in the process of FIG. 1.

Tables 3 to 5 illustrate results obtained when carrying out processes in accordance with FIGS. 1 and 2. In these processes the feed that was employed was already deslimed and therefore the results given do not include losses in slimes.

In the preferred form, the above-described imidazoline collectors are the sole collectors employed in the pyrochlore rougher and first and second cleaner stages. With decreasing pH, these imidazoline collectors show a greater tendency toward foaming and, if excessive foaming is found to be a problem, the imidazoline collector may be replaced wholly or partly by a conventional pyrochlore collector in the second cleaner stage. One example of such collector is DUOMAC-DUOMEEN-T which is a trade mark for a collector composition comprising a mixture of diamine diacetate and diamine in free form. The use of collectors other than the imidazoline collectors in the $Nb_2O_5$ rougher flotation and cleaner stage is not, however, preferred, owing to the reduced selectivity of the other collectors.

Although the above description gives ample information to permit one skilled in the art to carry out the recovery process, for the avoidance of doubt a detailed example will be given.

TABLE 3

| | FIG. 1; Ore high in carbonates | | | FIG. 2; Ore high in iron oxides and silicates. | | |
|---|---|---|---|---|---|---|
| | % W | % $Nb_2O_5$ | Distr. $Nb_2O_5$ | % W | % $Nb_2O_5$ | Distr. $Nb_2)_5$ |
| Feed: Pyrochlore | 100.0 | 0.67 | 100.0 | 100.0 | 0.71 | 100.0 |
| Tailings | 97.6 | 0.06 | 9.48 | *92.5 | 0.16 | 20.83 |
| Pyrite Conc.: | 0.9 | 0.61 | 1.00 | 0.6 | 0.49 | 0.41 |
| Pyrochlore Conc. | | | | | | |
| Leaching | 0.5 | 0.18 | 0.15 | 5.4 | — | — |
| Final Pyrochlore Concentrate: | 1.0 | 59.21 | 87.93 | 1.0 | 56.40 | 78.76 |

*including magnetics

TABLE 4

| REAGENT CONSUMED IN LB/T OF THE OVERALL FEED | FIG. 1 | FIG. 2 |
|---|---|---|
| Cationic Collector HOE-F-2642: | 1.090 | 1.254 |
| Copolymer of polyacrylamide DK-813 | 0.165 | 0.12 |
| $Na_2SiO_3$: | 0.239 | 0.02 |
| $H_2SiF_6$[fluosilicic acid] | 3.445 | 3.445 |
| $C_2H_2O_4$[oxalic acid] | 4.478 | 6.47 |

TABLE 5

| QUALITY OF THE FINAL CONCENTRATE | FIG. 1 | FIG. 2 |
|---|---|---|
| % $Nb_2O_5$: | 59.21 | 56.40 |
| % $SiO_2$: | 2.73 | 3.01 |
| % $P_2O_5$: | 0.02 | trace |
| % S | 0.90 | N.A. |
| % $Fe_t$: | 1.96 | 3.83 |

EXAMPLE

Pyrochlore ore from the St-Honore, Cte. Dubuc, Quebec, Canada region was employed. This contained 0.65% $Nb_2O_5$, 3.81% $SiO_2$, 4.04% $P_2O_5$ and 4.91% Fe. The ore was ground, classified to 95%—65 mesh, formed into an aqueous pulp and deslimed, rejecting −10 microns. The deslimed pulp was subjected to a rougher pyrochlore flotation and five stages of cleaners at progressively decreasing pH, followed by pyrite flotation, to obtain a sulphide concentrate, and leaching of the tailings therefrom (pyrochlore concentrate) with hydrochloric acid, to remove carbonate and apatite, leaving a pyrochlore concentrate as the residue.

Before the rougher stage, the pulp was conditioned with 1.30 lbs/ton of the feed of HOE F 2642 imidazoline collector and brought to pH 5.50 by addition of 1.10 lbs/ton of feed of $H_2SiF_6$.

The froth concentrate was conditioned by addition of 0.10 lbs/ton of the HOE F 2642 and brought to pH 4.65 with 0.60 lbs/ton of $H_2SiF_6$, and subjected to a first cleaner flotation.

The concentrate obtained was conditioned with 0.003 lbs/ton HOE F 2642, 0.05 lbs/ton DUOMAC DUOMEEN T diamine acetate/diamine collector, 0.05 lbs/ton DK 813 polyacrylamide copolymer silicate depressant and 0.50 lbs/ton oxalic acid. The pH was 4.50. The conditioned pulp was subjected to second flotation cleaning.

The froth concentrate from the second cleaner was conditioned with 0.004 lbs/ton HOE F 2642, 0.02 lbs/ton DUOMAC DUOMEEN T, 0.01 lbs/ton DK 813 and 0.60 lbs/ton oxalic acid and subjected to the 3rd cleaner flotation. The pH was 3.50.

The concentrate obtained was conditioned with 0.003 lbs/ton HOE F 2642, 0.01 lbs/ton DUOMAC DUOMEEN T, 0.01 lbs/ton DK 813 and 0.01 lbs/ton sodium silicate serving in combination with the DK 813 as depressant for biotite, chlorite, silicates, and iron oxides, together with 0.60 lbs/ton oxalic acid. The pH was 2.94. The pulp was subjected to 4th cleaners.

The concentrate was conditioned with 1.30 lbs/ton oxalic acid to obtain pH 2.55, and subjected to 5th cleaners.

The concentrate was subjected to a conventional pyrite flotation using sodium hydroxide as pH regulator to achieve pH 10.8, and conventional pyrite flotation xanthate as collector. The sulphide concentrate was removed.

The tailings (pyrochlore concentrate) were leached with 37% HCl at 80° C., to remove carbonate and apatite, leaving the final pyrochlore concentrate as residue.

Tables 6, 7, and 8 show the results achieved.

In the above Example, the HOE F 2642 imidazoline collector, the DUOMAC DUOMEEN T collector, and the DK 813 depressant were each employed as 1% solutions in cold water. The $Na_2SiO_3$, $H_2SiF_6$, and $C_2H_2O_4$ were each employed as 5% aqueous solutions.

TABLE 6

| | % W | % $Nb_2O_5$ | Distr. $Nb_2O_5$ |
|---|---|---|---|
| Overall Test Feed: | 100.0 | 0.65 | 100.0 |
| 1. Desliming: | 9.4 | 0.42 | 6.12 |
| 2. Pyrochlore Tailings: | 88.7 | 0.08 | 11.03 |
| 3. Sulphide Concentrate | 0.6 | 0.29 | 0.28 |
| 4. Carbonate & Apatite Leaching: | 0.4 | — | — |
| 5. Pyrochlore Concentrate: | 0.9 | 59.00 | 82.57 |

TABLE 7

| FINAL CONCENTRATE | |
|---|---|
| % $Nb_2O_5$: | 59.0 |
| % $SiO_2$: | 4.30 |
| % $P_2O_5$: | 0.02 |
| % S: | 0.67 |
| % $Fe_t$: | 2.31 |

TABLE 8

| REAGENT CONSUMPTION IN LB/SHORT TON OF THE OVERALL FEED. | |
|---|---|
| Imidazoline Collector HOE-F-2642 | 1.41 |
| Copolymer of Poly-Acrylamide DK-813: | 0.07 |
| $Na_2SiO_3$: | 0.01 |
| $H_2SiF_6$: | 1.70 |
| $C_2H_2O_4$: | 3.00 |

We claim:

1. Process for recovering a pyrochlore concentrate from an ore containing pyrochlore and gangue materials comprising silicates and substantial proportions of carbonates comprising: (1) subjecting an aqueous pulp of the ore to a first froth flotation in the presence of (a) a pyrochlore collector selected from the group consisting of 1-amidoethyl-2-substituted imidazolines of the formula

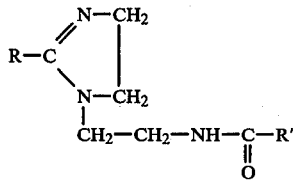

(I)

wherein R and R′ are independently selected from the group consisting of alkyl and alkenyl groups of 8 to 22 carbon atoms, their salts, and mixtures thereof; and (b) an acidic-reacting fluoridic compound selected from the group consisting of hydrofluoric acid, fluoride compounds, fluosilicic acid, fluosilicate compounds, and mixtures thereof in an amount sufficient to modify the pH of the pulp to an acidic pH; (2) subjecting an aqueous pulp of the froth concentrate obtained from step (1) to a second froth flotation in the presence of a further quantity of said pyrochlore collector and a further quantity of said acidic-reacting fluoridic compound in an amount sufficient to modify the pH of the pulp to an acidic pH below the pH used in step (1); steps (1) and (2) being conducted in the presence of said fluoridic compound as the sole acidifying reagent and in the absence of oxalic acid or oxalate; and (3) subsequently subjecting an aqueous pulp of material recovered as the froth concentrate from step (2) to a froth flotation in the presence of a pyrochlore collector and oxalic acid or an acidic-reacting oxalate compound and at an acidic pH below the pH used in step (2); and recovering the froth concentrate obtained from step (3).

2. Process as claimed in claim 22 wherein said ore comprises at least 0.1% by weight sulphide compounds calculated as pyrite ($Fe_2S$).

3. Process as claimed in claim 2 wherein the content of sulphide compounds is about 0.15 to 3% by weight calculated as pyrite ($FeS_2$).

4. Process as claimed in claim 1 wherein the fluoridic compound is fluosilicic acid, a fluosilicate compound, or a mixture thereof.

5. Process as claimed in claim 1 wherein R and R′ are each alkyl groups.

6. Process as claimed in claim 5 wherein the alkyl groups are each of 12 to 18 carbon atoms.

7. Process as claimed in claim 1 wherein the ore in said pulp contains at least about 50% by weight carbonates, calculated as calcium carbonate.

8. Process as claimed in claim 1 wherein the ore in said pulp contains at least about 60% by weight carbonates, calculated as calcium carbonate.

9. Process as claimed in claim 1 wherein the pH in step (1) is about 5.5 to 5.8.

10. Process as claimed in claim 1 wherein the pHs in steps (1) and (2) are in the range about 4.5 to about 6.5.

11. Process as claimed in claim 1, 10, or 9 wherein the pH in step (3) is below about 5.

12. Process for recovering a pyrochlore concentrate by direct froth flotation from an ore containing pyrochlore and gangue materials comprising substantial proportions of carbonates, said process comprising the steps of: (1) forming an aqueous pulp of the ore in small particle size suitable for froth flotation, conditioning the pulp by adding thereto (a) a collector selected from the group consisting of 1-amidoethyl-2-substituted-imidazolines of the formula

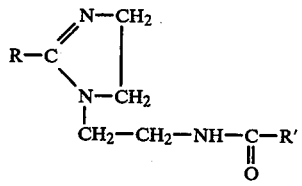

(I)

wherein R and R′ are independently selected from the group consisting of alkyl and alkenyl groups of 8 to 22 carbon atoms, their salts, and mixtures thereof, in an amount sufficient to collect at least a substantial proportion of the pyrochlore mineral present in the pulp, and (b) an acidic-reacting fluoridic compound selected from the group consisting of hydrofluoric acid, fluoride compounds, fluosilicic acid, fluosilicate compounds, and mixtures thereof in an amount sufficient to modify the pH of the pulp to a pH in the range about 5.5 to 5.8, subjecting the conditioned pulp to froth flotation and recovering a primary concentrate froth relatively rich in pyrochlore; (2) subsequently cleaning said primary froth concentrate by forming an aqueous pulp therefrom, conditioning the pulp with a further amount of said collector and a further amount of said fluoridic compound to reduce the pH to below about 5, subjecting the conditioned pulp to a second flotation, and recovering a secondary froth concentrate which is substantially free from carbonates; steps (1) and (2) being conducted in the substantial absence of oxalic acid or oxalate; and (3) subsequently cleaning the secondary froth concentrate by forming an aqueous pulp therefrom, conditioning the pulp by adding thereto oxalic acid or oxalate to attain a pH below 5, and a collector for pyrochlore, subjecting the pulp to froth flotation and collecting a tertiary cleaned pyrochlore froth concentrate.

* * * * *